US012339109B1

(12) United States Patent
Merryman

(10) Patent No.: US 12,339,109 B1
(45) Date of Patent: Jun. 24, 2025

(54) BULLET FEEDER DEVICE

(71) Applicant: Christopher Paul Merryman, Bowling Green, MO (US)

(72) Inventor: Christopher Paul Merryman, Bowling Green, MO (US)

( * ) Notice: Subject to any disclaimer, the term of this patent is extended or adjusted under 35 U.S.C. 154(b) by 0 days.

(21) Appl. No.: 18/438,800

(22) Filed: Feb. 12, 2024

Related U.S. Application Data

(60) Provisional application No. 63/448,135, filed on Feb. 24, 2023.

(51) Int. Cl.
*F42B 33/10* (2006.01)
*F42B 33/00* (2006.01)

(52) U.S. Cl.
CPC ..... *F42B 33/002* (2013.01)

(58) Field of Classification Search
CPC ..... F42B 33/002; F42B 33/001; F42B 33/005
See application file for complete search history.

(56) References Cited

U.S. PATENT DOCUMENTS 4,475,435 A 10/1984 Mantel
5,763,810 A 6/1998 Lee
5,932,828 A 8/1999 Hornady et al.
6,041,687 A 3/2000 Fowler
8,276,494 B2 10/2012 Palkowitsh
8,707,845 B2 4/2014 Koch et al.
9,267,775 B1 2/2016 Kleinschmit
11,326,864 B1 * 5/2022 McPherson ..... F42B 33/005
2008/0053297 A1 3/2008 Koskela
2010/0275762 A1 * 11/2010 Koch ..... F42B 33/002 86/24
2016/0040969 A1 * 2/2016 Kleinschmit ..... F42B 33/001 86/43

* cited by examiner

*Primary Examiner* — J. Woodrow Eldred
(74) *Attorney, Agent, or Firm* — John Rizvi; John Rizvi, P.A.—The Patent Professor ®

(57) ABSTRACT

An improved bullet feeder and seating die device for progressively inserting bullets into mouths of cartridge casings is disclosed. The bullet feeder device includes a seating die having a main die body having a threaded portion and a clearance cut and a passageway extending through the threaded portion to a bore of the main die body. A die lock having a threaded inner surface is provided to receive the threaded portion of the main die body. The die lock has a clearance slot alignable with the clearance cut in the main die body. A feed assembly is provided to sequentially supply bullets to the seating die and a activation assembly is provided to operate the feed assembly. A mounting assembly is provided to hold the seating die, feed assembly and a activation assembly together.

20 Claims, 9 Drawing Sheets

BULLET FEEDER DEVICE

CROSS-REFERENCE TO RELATED APPLICATIONS

This application claims the benefit of U.S. Provisional Patent Application Ser. No. 63/448,135, filed on Feb. 24, 2023, which is incorporated by reference herein in its entirety.

FIELD OF THE INVENTION

The present invention relates generally to bullet reloading devices, and more particularly, to an improved bullet feeder device for use with a progressive type reloading press.

BACKGROUND OF THE INVENTION

In the shooting sports many people reload their own ammunition. This is typically accomplished by taking an empty cartridge casing, priming it and filling it with gun powder. The cartridge casing is then placed in a loading press. The loading press has a bullet seating die that pushes a bullet positioned over a mouth of the cartridge casing down into the casing to seat the bullet and form a fully loaded cartridge. This is accomplished one bullet/cartridge casing at a time.

Some shooters shoot hundreds of rounds of cartridges during target practice, competitions and the like. Loading bullets in cartridges on a press that can only accommodate one cartridge at a time can be tedious. Progressive presses are available that can sequentially load cartridges with bullets from a supply of bullets fed into a bullet seating die. Unfortunately, many of these presses are difficult to use and cannot accommodate all styles of bullets.

Accordingly, there is need for a solution to at least one of the aforementioned problems. For instance, there is an established need for an improved bullet feeder device that can easily supply bullets to a bullet seating die.

SUMMARY OF THE INVENTION

The present invention is directed to an improved bullet feeder and seating die device for progressively inserting bullets into mouths of cartridge casings. The bullet feeder device includes a seating die having a main die body having a threaded portion and a clearance cut and a passageway extending through the threaded portion to a bore of the main die body. A die lock having a threaded inner surface is provided to receive the threaded portion of the main die body. The die lock has a clearance slot alignable with the clearance cut in the main die body. A feed assembly is provided to sequentially supply bullets to the seating die and an activation assembly is provided to operate the feed assembly. A mounting assembly is provided to hold the seating die, feed assembly and activation assembly together.

In a first implementation of the invention, a bullet feeder and seating device for seating a bullet in a mouth of a cartridge casing is provided, the bullet feeder device comprising:

- a seating die including a main die body having a smooth outer surface and a threaded outer surface and defining an inner bore, said main die body defining a clearance cut extending through said smooth outer surface and said threaded outer surface to said inner bore, said main die body defining a passageway extending through said smooth outer surface and said threaded inner surface to said inner bore, and an inner die assembly having a pivotal bullet pusher;
- a die lock having a threaded inner surface engagable with said threaded outer surface of said main die body, said die lock defining a clearance slot alignable with said clearance cut in said main die body;
- an activation sleeve movably mounted within said main die body and defining an inner bore;
- a mounting assembly including a main body holder defining a channel, said seating die being removably attached to said main body holder;
- an actuator having a rectangular portion and a triangular portion extending from said rectangular portion and a drive shaft extending upward from said rectangular portion, said rectangular portion being slidably mounted within said channel of said main body holder;
- a first indexing block mounted on said main body holder and defining a drop hole and a shaft hole;
- a second indexing block pivotally mounted on said first indexing block and defining a feed hole and a cam surface on an underside of said second indexing block; and
- a feed tube mounted above said second indexing block.

In a second aspect, said passageway in the main die body is positioned diametrically opposite the clearance cut in the main die body.

In another aspect, a biasing spring is positioned over the drive shaft and under the first indexing block.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an improved bullet feeding and seating die device for use with a bullet seating press.

Figure 1:
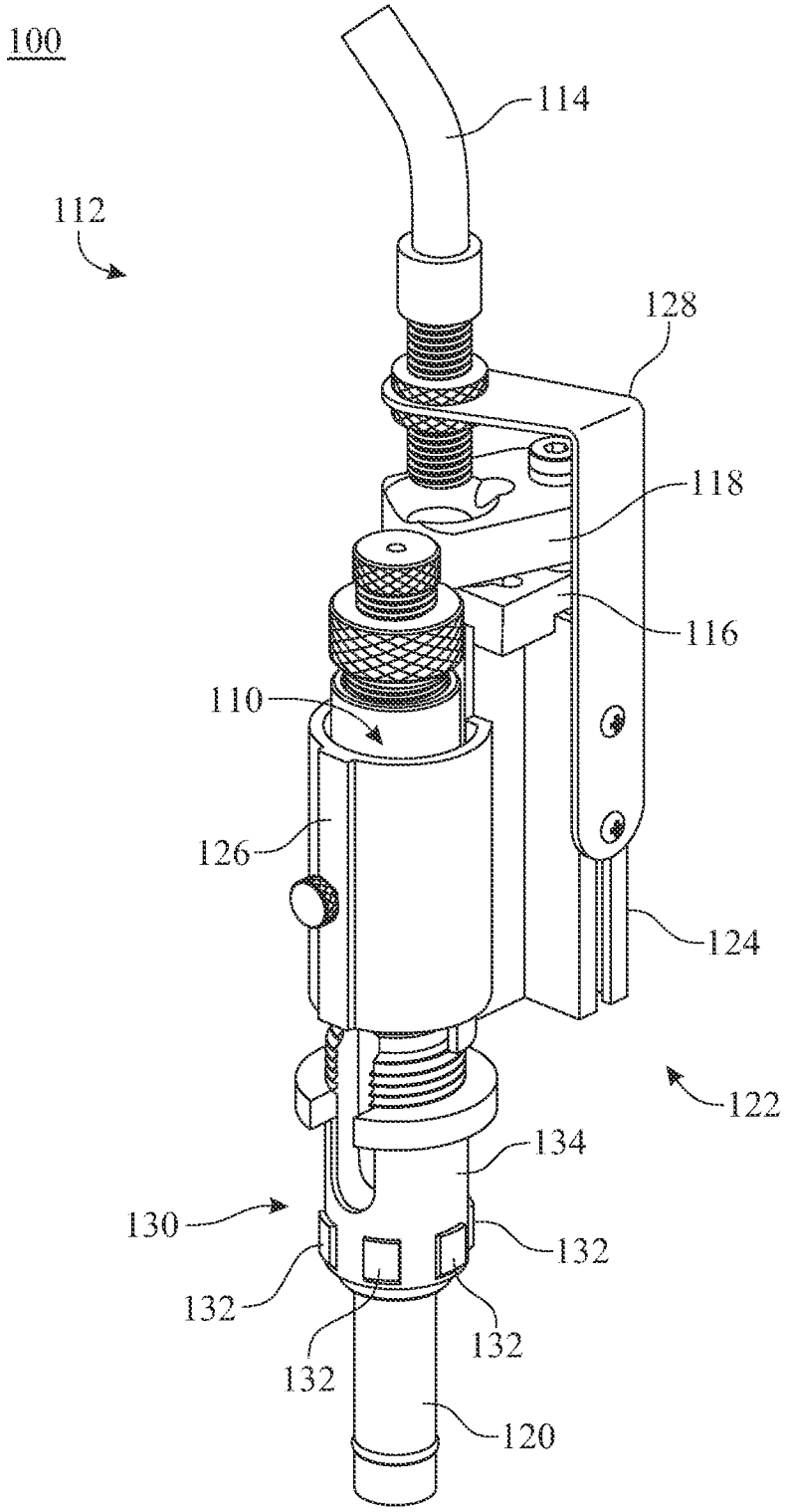
FIG. 1 presents a front isometric view of an improved bullet feeder and seating die device in accordance with an illustrative embodiment of the present invention.
Figure 2:
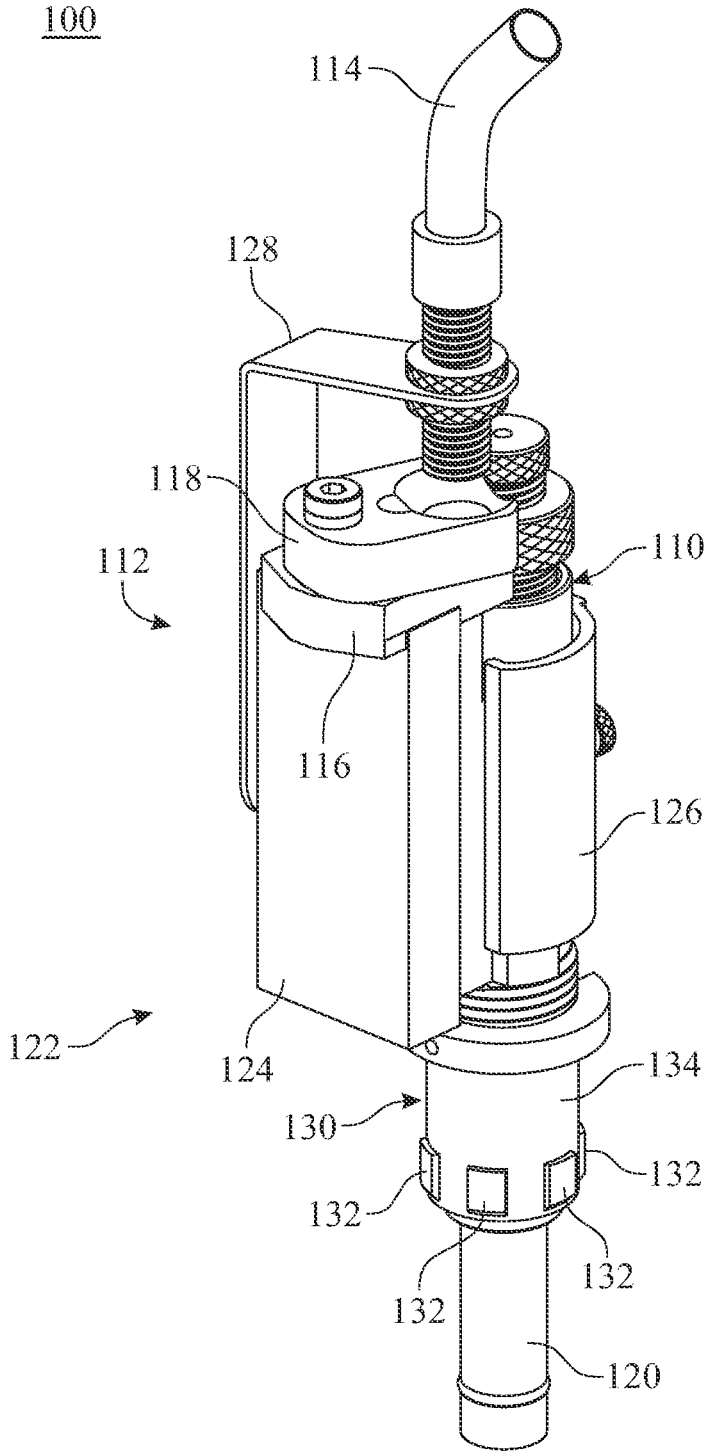
FIG. 2 presents a rear isometric view the improved bullet feeder and seating die device illustrated in FIG. 1.
Figure 3:
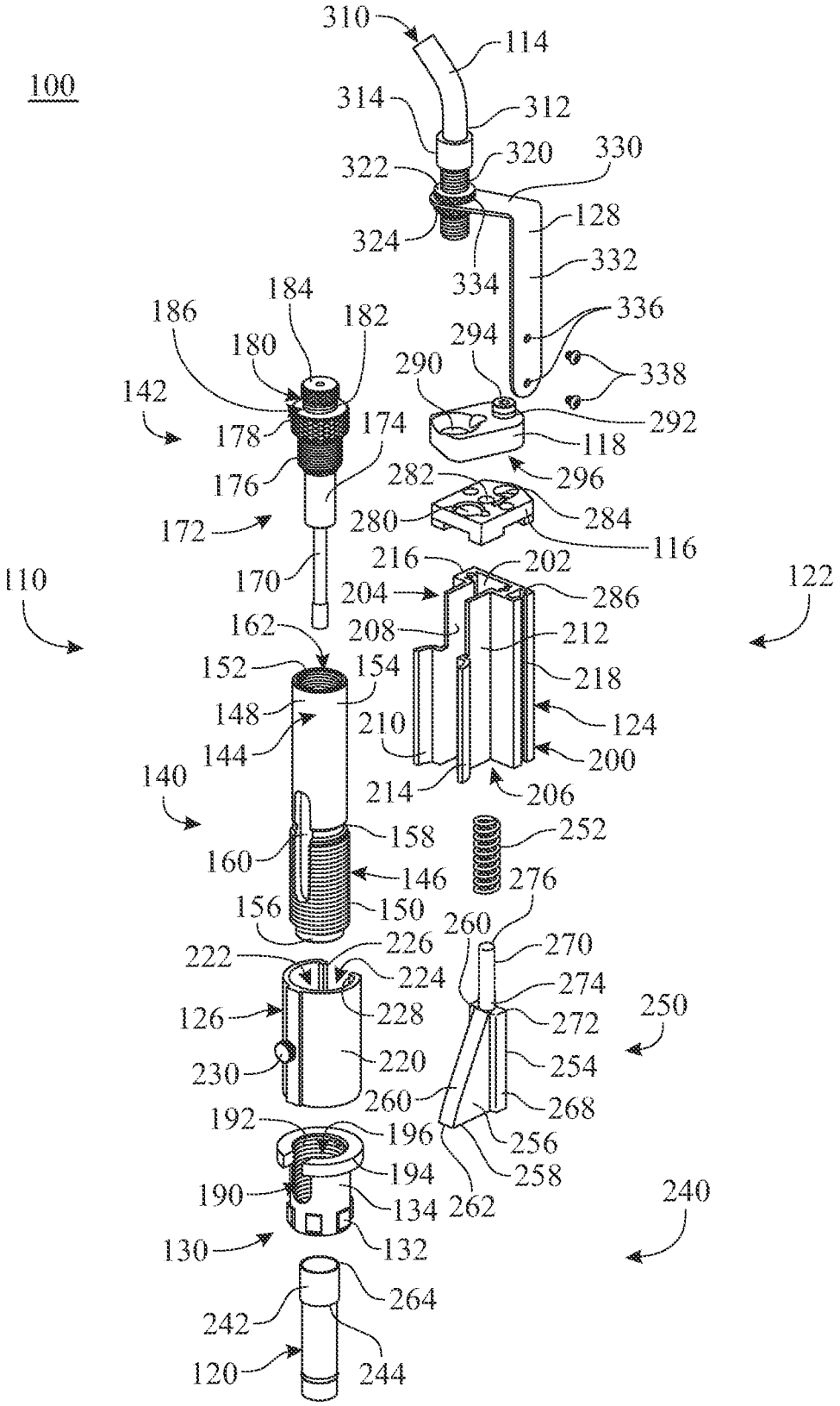
FIG. 3 presents a front isometric view, with parts separated, of the improved bullet feeder and seating die device of FIG. 1.

Referring to FIGS. 1-3, and initially with regard to FIGS. 1 and 2, an improved bullet feeding and seating die device for use in progressively seating bullets in bullet casings, hereinafter bullet feeding device 100, is illustrated in accordance with an exemplary embodiment of the present invention. As shown, the bullet feeding device 100 generally includes a bullet seating die 110 for seating a bullet (not shown) into a bullet casing (also not shown) and a feed assembly 112 for sequentially supplying the bullets to the bullet seating die 110.

The feed assembly 112 includes a drop tube 114 for retaining and supplying a bullet, a first indexing block 116 and a second pivotal indexing block 118 for holding and releasing the bullets into the bullet seating die 110. An activation sleeve 120 is movably mounted within the bullet seating die 110 and is operable to pivot the second indexing block 118 so as to release a bullet into the bullet seating die 110 in a manner described in more detail hereinbelow.

The bullet feeding device 100 further include a mounting assembly 122 for securing the feed assembly 112 to the bullet seating die 110. The mounting assembly 112 includes a main body holder 124 for holding the bullet seating die 110 and mounting the first and second indexing blocks 116 and 118. The mounting assembly 112 also includes an outside body holder 126 for securing the bullet seating die 110 to the main body holder 124. The mounting assembly additionally includes a mounting bracket 128 affixed to the drop tube 114 and the main body holder 124 to support and position the drop tube 114 over the first and second indexing blocks 116 and 118.

An improved die lock 130 is provided to releasably support and attach the bullet seating die 110 to a bullet seating press (not shown). A plurality of projections 132 extending from a body 134 of the die lock 130 allow the die lock 130, and thus the bullet feeding device 100, to be releasably attached to the bullet seating press in quick release bayonet fashion.

Referring now to FIG. 3, the bullet seating die 110 generally includes a cylindrical main die body 140 and an inner die assembly 142 mounted within the main die body 140. The main die body 140 includes an upper portion 144 and a lower portion 146. The upper portion 144 of the main die body 140 has a smooth outer surface 148 while the lower portion of the main die body 140 has a threaded outer surface 150. The threaded outer surface 150 of the lower portion 146 is provided to secure the bullet seating die 110 within the die lock 130. The main die body 140 has a threaded inner surface 152 in an upper end 154 of the main die body for adjustably receiving the inner die assembly 142. The main die body 140 additionally includes a smaller diameter lower end 156. A groove 158 is defined between the upper and lower portions 144 and 146, respectively.

As shown, the main die body 140 includes a lengthened elongated oval clearance slot 160 extending through the main die body 140. The clearance slot 160 extends through both the upper and lower portions 144 and 146 of the main die body 140. More specifically, the clearance slot extends through the smooth outer surface 148 of the upper portion 144 of the main die body 140 and through a substantial amount of the threaded outer surface 150 of the lower portion 146 of the main die body 140. The clearance slot 160 extends from the smooth and threaded outer surfaces 148 and 150, respectively, to an inner bore 162 of the main die body 140.

The inner die assembly 142 generally includes an elongated die stem or pusher 170 pivotally supported within a hollow pusher support 172. The pusher support 172 has a hollow lower sleeve 174 and a threaded upper portion 176. The threaded upper portion 176 of the pusher support 172 is threadingly engagable with the inner threaded surface 152 of the main die body 140 to secure the inner die assembly 142 within the main die body 140. The pusher support 172 has a collar 178 to facilitate rotating the inner die assembly 142 into the main die body 140.

The inner die assembly 142 additionally includes an adjustment shaft 180 connected to the pusher 170 and mounted within the pusher support 172. The adjustment shaft 180 includes a threaded outer surface 182 which engages a threaded inner surface (not shown) of the pusher support 172. By rotating the adjustment shaft 180 within the pusher support 172, the longitudinal position of the pusher 170 within the main die body 140 can be adjusted. This allows a user to adjust the depth to which a bullet is seated within a cartridge casing. A cap 184 is provided at an upper end 186 of the adjustment shaft 180 to facilitate rotating the adjustment shaft 180.

The die lock 130 also includes a clearance slot 190 which, when assembled to the seating die 110, aligns with the clearance cut 160 defined in the main die body 140. The die lock 130 includes a threaded inner surface 192 threadingly engageable with the threaded outer surface 150 of the main die body 140. Threading the main die body 140 into the die lock 130 secures the seating die 110 within the die lock 130 and subsequently within the bullet seating press. The die lock 140 further includes a circumferential upper flange 194. The clearance slot 190 of the die lock 130 extends through the upper flange 194 as well as through the body 134 of the die lock 130. The die lock 130 defines an internal bore 196 for receipt of the seating die 110 and passage of the pusher 170. When a bullet is dropped through the seating die 110, the pusher 170 pivots out of the way through the clearance slot 160 in the seating die 110 and through the aligned clearance slot 190 of the die lock 130.

As noted herein above, the feed assembly 112 is secured to the seating die 110 with the mounting assembly 122. Specifically, the main body holder 124 and the outside body holder 126 retain the seating die 110 in the mounting assembly 122. The main body holder 124 generally includes a channel shaped body portion 200 defining an interior channel 202. A first arm 204 and a second arm 206 extend outwardly from the body portion 200. The first arm 204 includes a first flat portion 208 extending from the body portion 200 and a first arcuate portion 210 extending from the first flat portion 208. Similarly, the second arm 206 includes a second flat portion 212 extending from the body portion 200 and a second arcuate portion 214 extending from the second flat portion 212. The first and second arcuate portions 210 and 214 are shaped to surround the seating die 110. The body portion 200 of the main body holder 124 further includes vertical side grooves 216 and 218 for securing the mounting bracket 128, and thus the drop tube 114, to the main body holder 124.

The outside body holder 126 includes a cylindrical body portion 220 defining a bore 222 for receipt of the seating die 110. The cylindrical body portion 220 further defines a vertical slot or gap 224 having edges 226 and 228. When assembled to the main body holder 124, the edges 226 and 228 of the cylindrical body portion 220 of the outside body holder 126 extend around the first and second arcuate portions 210 and 214 of the main body holder 126. A set screw 230 extends into the bore 222 of the cylindrical body portion 220 to secure the seating die 110 therein.

As noted above, the activation sleeve 120 is movably mounted within the seating die 110 and operable to move the pivotal second indexing block 118. The activation sleeve 120 forms part of an activation assembly 240 and includes an enlarged upper end 242 having a lower edge 244. The lower edge 244 of the activation sleeve 120 is larger in diameter that the smaller diameter lower end 156 of the main die body 140. Thus, the activation sleeve 120 is retained within the bore 162 of the main die body 140.

The activation assembly 240 additionally includes an actuator 250, slidably mounted in the main body holder 124 and a biasing spring 252 for biasing the actuator 250 and the activation sleeve 120 downward within the bullet feeding device 100. The actuator 250 generally includes a rectangular portion 254 and a triangular portion 256 extending from the rectangular portion 254. The triangular portion 256 includes a flat bottom 258 and an angled bullet feed ramp 260. A front edge 262 of the flat bottom 258 of the triangular portion 256 rides on a top circumferential edge 164 of the enlarged upper end 242 of the activation sleeve 120. The rectangular portion 256 of the actuator 250 includes side edges 266 and 268 which ride within the channel 202 of the channel shape body portion 200 of the main body holder 124. Thus, as the activation sleeve 120 is moved upward within the seating die 110, the actuator 250 is moved upward within the main body holder 124 against the bias of the biasing spring 252.

As noted above, the movement of the activation sleeve 120 causes the second indexing block 118 to pivot into alignment with the first indexing block 114 to drop a bullet therethrough. The actuator 250 further includes a drive shaft 270 extending upwardly from the rectangular portion 254 of the actuator 250. The drive shaft 270 extends from a top edge 272 of the rectangular portion. Specifically, a bottom end 274 of the drive shaft 270 extends from the top edge 272 of the rectangular portion and a top end 276 of the drive shaft 250 extends through the first indexing block 116 and engages the second indexing block 118.

The first indexing block 116 includes a drop hole 280 for passage of a bullet and a shaft hole 282 for passage of the drive shaft 270 of the actuator 250. The first indexing block further includes a mounting hole 284 for securing the first indexing block 116 to a top edge 286 of the channel shaped body portion 200 of the main body holder 124.

The second indexing block 118 includes a feed hole 290 for receipt of a bullet from the drop tube 114 and passing the bullet to the drop hole 280 of the first indexing block 116 when the second indexing block 118 is aligned with the first indexing block 116. The second indexing block 118 also includes a mounting hole 292. A mounting bolt or screw 294 is provided to mount both the first and second indexing blocks 116 and 118 to the man body holder 124. The mounting screw 294 extends through the second indexing block 118 such that the second indexing block 118 can pivot about the mounting screw 294 relative to the first indexing block 116.

The second indexing block 118 includes a cam surface 296 on an underside 298 of the second indexing block 118. The cam surface 296 is engaged by the top end 276 of the drive shaft 270 of the actuator 250 when the actuator 250 is moved upward. As the drive shaft 270 rides in the cam surface 296 of the second indexing block 118, the second indexing block 118 is pivoted into alignment with the first indexing block 116 to align the feed hole 290 of the second indexing block 118 with the drop hole 280 of the first indexing block 116 to allow a bullet to pass there through. While not specifically shown, a biasing spring is provided to bias the second indexing block 118 out of alignment with the first indexing block 116. Engagement of the second indexing block by the drive shaft 270 of the actuator 250 moves the second indexing block 118 against the bias of the biasing spring.

Bullets are supplied to the first and second indexing blocks 116 and 118 by the drop tube 114 which is supported on the main body holder 124 by the mounting bracket 128. The drop tube 114 is hollow and has an open first end 310 for receipt of bullets and a second end 312 terminating in an internally threaded collar 314. A hollow, externally threaded extension 310 extends from and is threaded into the threaded collar 314 of the drop tube 114. First and second lock rings 322 and 324, respectively, are provided on the threaded extension 310 to secure the threaded extension 310 to the mounting bracket 128.

The mounting bracket 128, in turn, includes a horizontal portion 330, mounting the drop tube 114, and a vertical portion 332 affixed to the main body portion 124. More specifically, the horizontal portion 330 of the mounting bracket 128 includes a hole 334. The threaded extension 310 is inserted through the hole 334 in the horizontal portion 330 of the mounting bracket 128 and secured in place with the first and second lock rings 322 and 324. The height of the threaded extension 310 over the second indexing block 118 can be adjusted by adjusting the positions of the first and second lock rings 322 and 324 on the threaded extension 310.

The vertical portion 332 of the mounting bracket 128 includes holes 336 and is secured to the main body portion 124 of the mounting assembly 122 by screws 338. The screws 338 pass through the holes 336 in the vertical portion and into one of the side grooves 216 or 218 on the main body portion 124. Thus, the height of the drop tube 114 above the second indexing block 118 is fully adjustable.

Figure 4A:
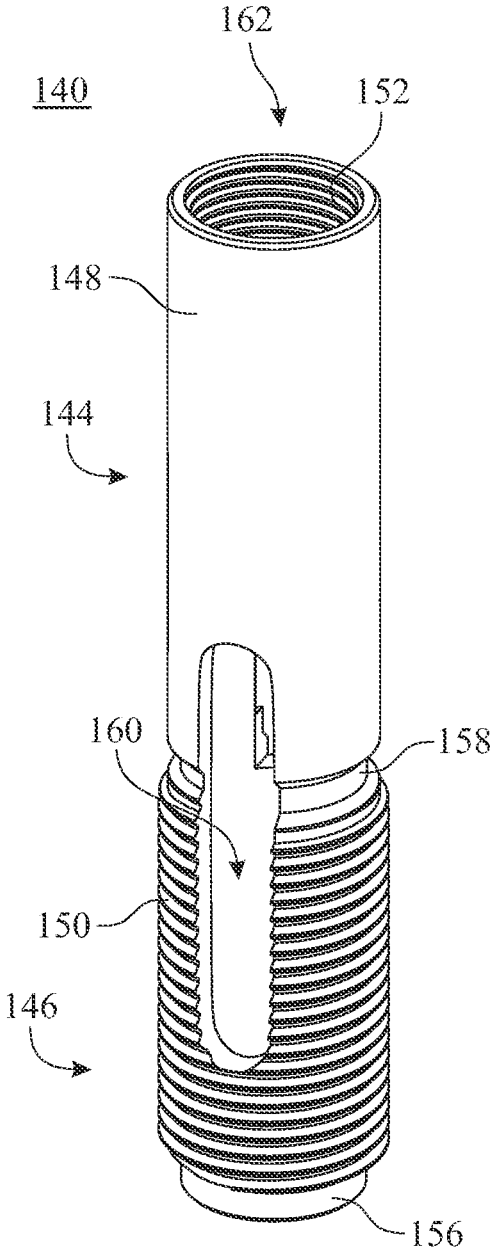
FIG. 4A presents a front isometric view of a die body of the improved bullet feeder and seating die device of FIG. 1.
Figure 4B:
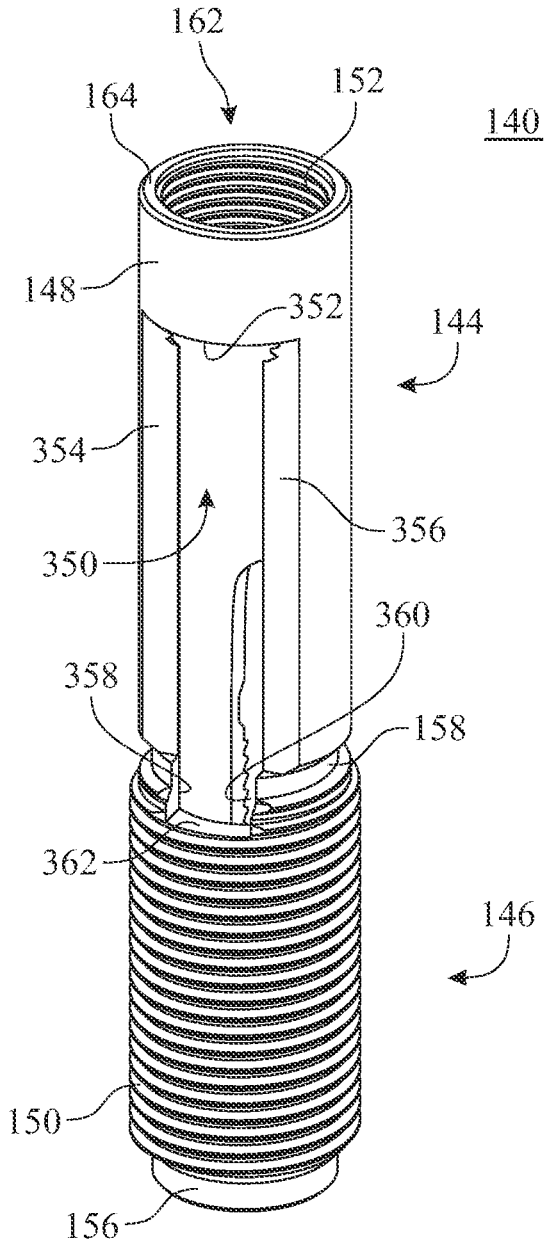
FIG. 4B presents a rear isometric view of the die body of the improved bullet feeder and seating die device of FIG. 4A.

Referring now to FIGS. 4A and 4B, and initially to FIG. 4A, the lengthened oval clearance cut 160 extends a substantial length through the threaded outer surface 150 of the lower portion 146 of the main die body 140. Specifically, the clearance cut 160 extends through the smooth outer surface 148 of the upper portion 144, transects through the groove 158 and extends through the threaded outer surface 150 of the lower portion 146.

With specific reference to FIG. 4B, the main die body 140 further includes a generally rectangular passageway 350 cut through the main die body 140 and located diametrically opposite of the clearance cut 160. The passageway 350 is provided to receive the angled portion 256 of the actuator 250. Bullets dropped onto the actuator 250 by the first and second indexing blocks 116 and 118, respectively, ride down the feed ramp 260 of the actuator 250 which guides the bullets through the passageway 350 and into the bore 162 of the main die body 140.

The passageway 350 extends through the upper portion 144, the groove 158 and the threaded lower portion 146 of the main die body 140. The passageway 350 includes a top edge 352 in the upper portion 144 and angled vertical side edges 354 and 356 also extending through the upper portion 144. Flat or perpendicular side edges 358 and 360 extend downward from the angled side edges 354 and 356, respectively, and are cut through the groove 158 and into the lower portion 146. Thus, the perpendicular side edges 358 and 360 extend through the threaded outer surface 150 of the lower portion 146. The passageway 350 terminates in a bottom edge 362 also cut through the threaded outer surface 150 of the lower portion 146.

In a preferred embodiment, the threaded outer surface 150 is a ⅞-14 thread and the threaded inner surface is a ¾-18 thread. The passageway 350 starts 12.81 mm from a top edge 164 of the upper portion and extends downward 70.05 mm from the top edge 164. The passageway 350 has a width of 9.6 mm.

Figure 5A:
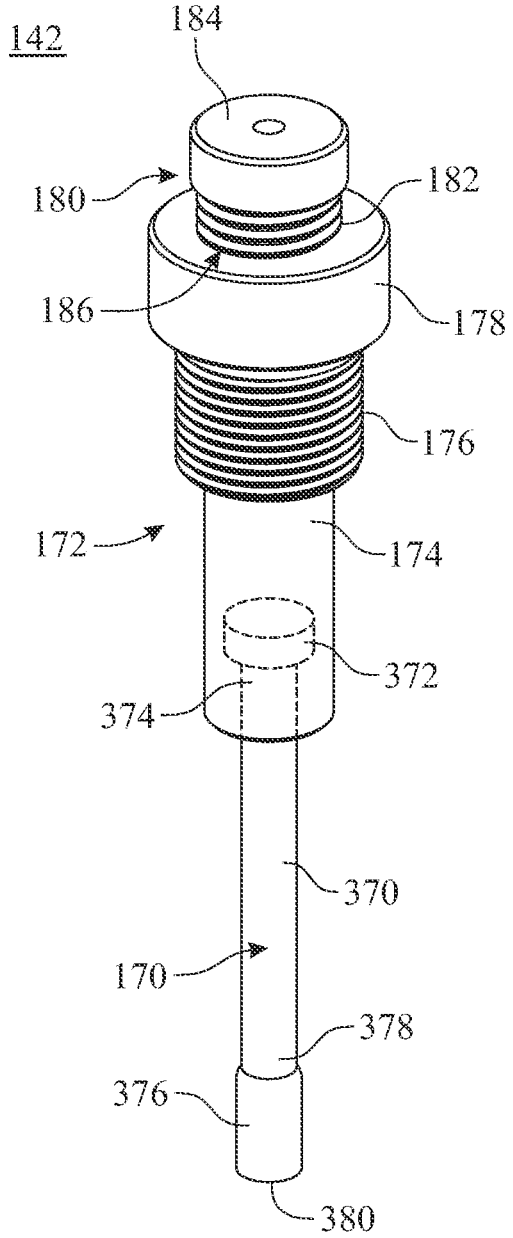
FIG. 5A presents a front isometric view of a die stem assembly, including a bullet pusher, of the improved bullet feeder and seating die device of FIG. 1.
Figure 5B:
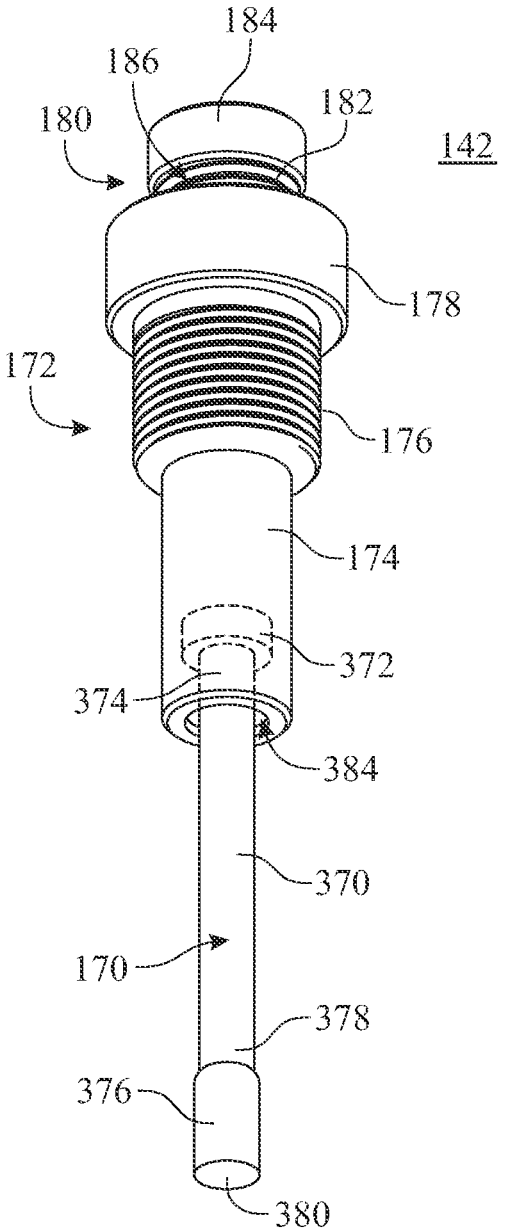
FIG. 5B presents a rear isometric view of the die stem assembly of FIG. 5A.

Turning to FIGS. 5A and 5B, it can be seen that the pusher 170 has a central shaft 370 having a top cap 372 at a top end 374 of the central shaft 370 and a bullet seating cap 376 extending from a bottom end 378 of the central shaft 370. A bullet seating surface 380 is formed on the bullet seating cap 376. The bullet seating surface 380 engages a bullet and pushes or urges the bullet into a mouth of a cartridge casing to seat the bullet in the cartridge casing (not shown). In a preferred embodiment, the pusher 170 has an overall length of 58.41 mm and the top cap 372 has a diameter of 8.61 mm and a thickness of 3.25 mm. The seating cap has a length of 3.54 mm.

As shown, the hollow sleeve 174 of the pusher support 172 of the inner die assembly 142 defines a hollow bore 384. The pusher 170 is movably mounted within the bore 384 of the hollow sleeve 174 and is free to pivot relative thereto. This allows the pusher 170 to pivot out of the way of a bullet moving through the rectangular passageway 350 of the main die body 140 and fall beneath the pusher 170 where it is temporarily captured within the activation sleeve 120.

Figure 6A:
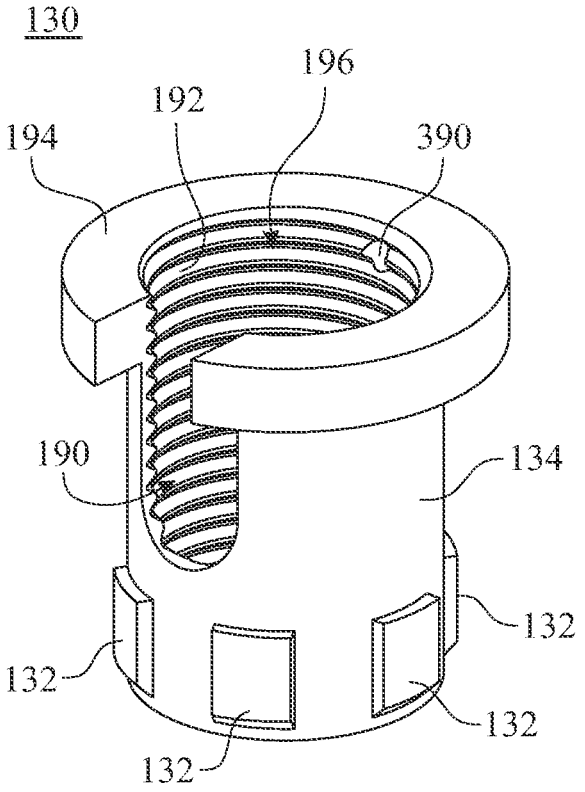
FIG. 6A presents a front isometric view of a die lock of the improved bullet feeder and seating die device for releasably securing the improved bullet feeder and seating die device to bullet seating press.
Figure 6B:
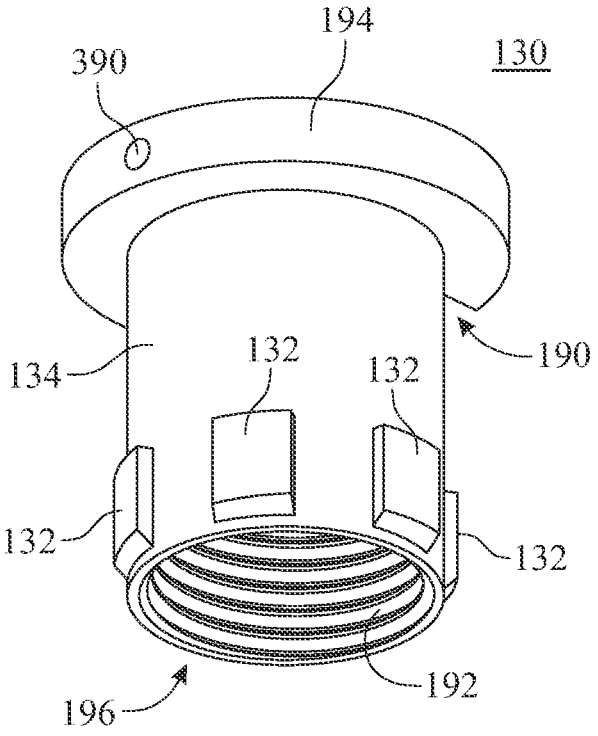
FIG. 6B presents a rear isometric view of the die lock of FIG. 6A.

Referring for the moment to FIGS. 6A and 6B, as noted above, the die lock 130 includes a clearance slot 190 cut through both the body 134 and upper flange 194 of the die lock 130. When the main die body 140 is threaded into the die lock 130, the main die body 140 is rotated to align the clearance cut 160 through the main die body 140 with the clearance slot 190 through the die lock 130. In order to secure this alignment, the die lock 130 includes a hole 390 for receipt of a set screw (not shown). In a preferred embodiment, the threaded inner surface 192 of the die lock 130 has a ⅞-14 thread to receive the main die body 140.

Figure 7A:
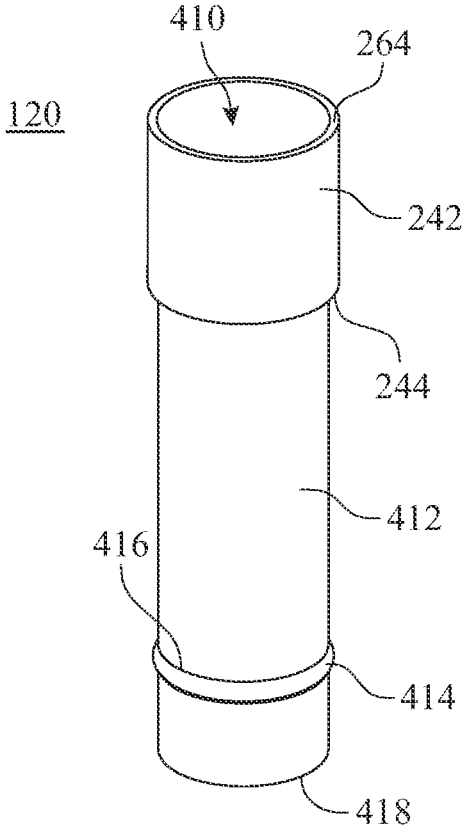
FIG. 7A presents an isometric view of an activation sleeve of the improved bullet feeder and seating die device.
Figure 7B:
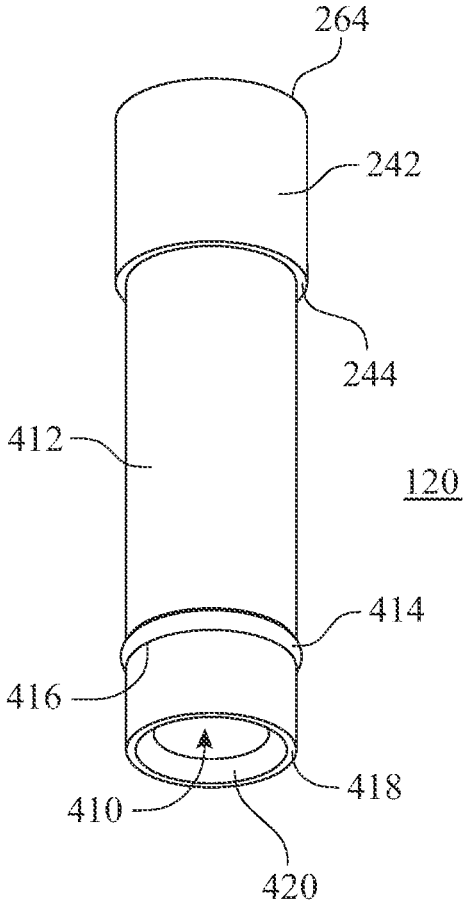
FIG. 7B presents a rear isometric view of the activation sleeve of FIG. 7A.

Referring to FIGS. 7A and 7B, the activation sleeve 120 has a through bore 410 for passage of bullets. An elongate cylinder 412 extends downwardly from the enlarged upper end 242. A soft, flexible o-ring 414 is seated in a groove 416 adjacent to a bottom end 418 of the elongate cylinder 412. While not specifically shown, the groove 416 has areas open to the through bore 410 such that the o-ring 414 slightly protrudes into the through bore 410. Thus, as a bullet is passed down into the activation sleeve 120 from the seating die 110, the bullet rests against the inwardly protruding o-ring 414 until pushed past the o-ring 414 by the pusher 170. The elongate cylinder 412 has a chamfered inner surface 420 within the through bore 410 at the bottom end 418 of the elongate cylinder 412 (FIG. 7B). In a preferred embodiment, the chamfered inner surface 420 is 1.5×1.5 mm and the through bore 410 is 9.53 mm. The activation sleeve 120 has an overall length of 58 mm and the enlarged upper end 242 has a length of 15 mm. The groove 416 has a width of 2 mm.

Figure 8A:
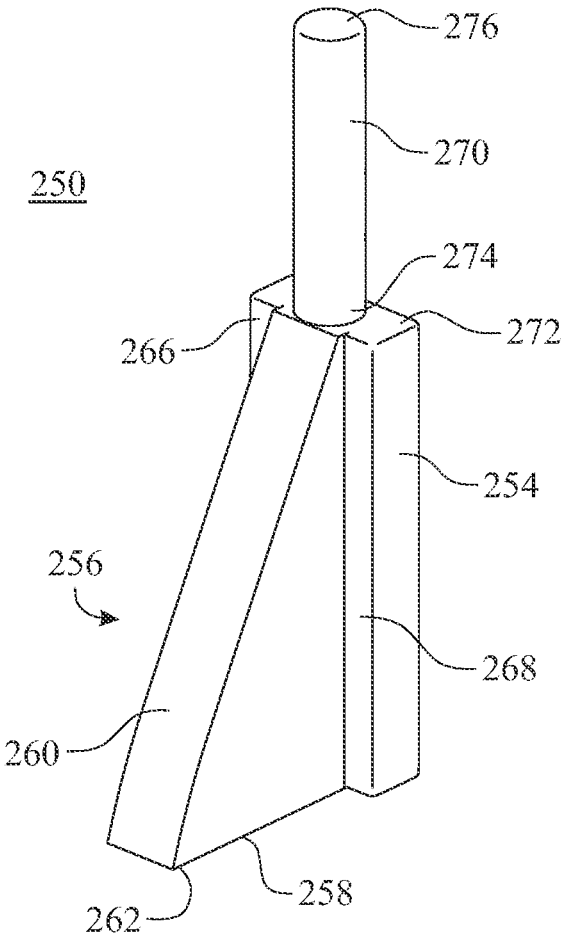
FIG. 8A presents a front isometric view of an actuator of improved bullet feeder and seating die device.
Figure 8B:
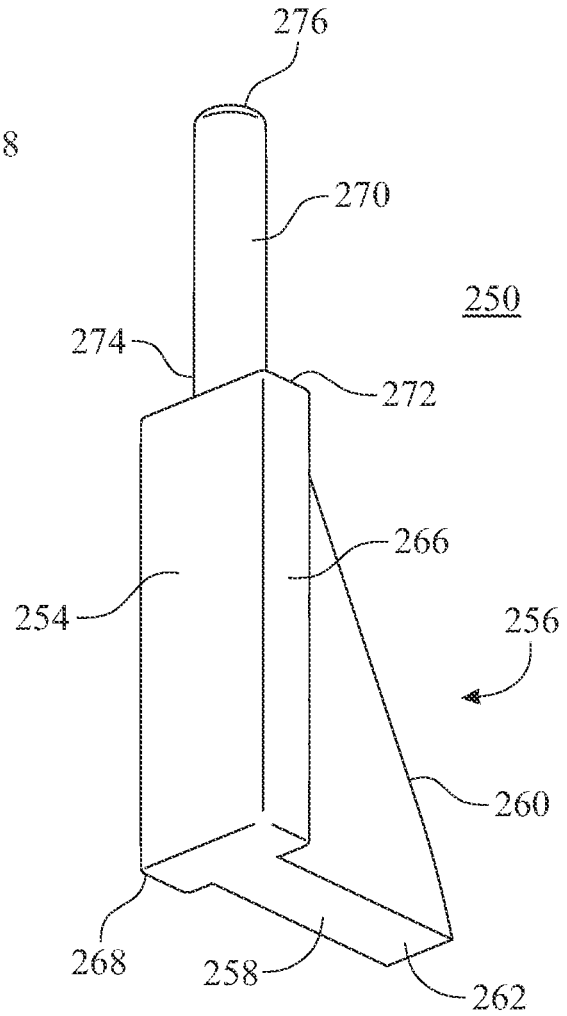
FIG. 8B presents a rear isometric view of the actuator of FIG. 8A.

Referring to FIGS. 8A and 8B, the overall length of the actuator 250 is 73 mm and the drive shaft 270 of the actuator 250 has a length of 28.60 mm and a diameter of 6.34 mm. The rectangular portion 254 has an overall length of 44 mm and a width of 15.2 mm. The feed ramp 260 of the triangular portion 256 has a length of 48.57 mm and the feed ramp 260 has a width of 7.83 mm.

Figure 9A:
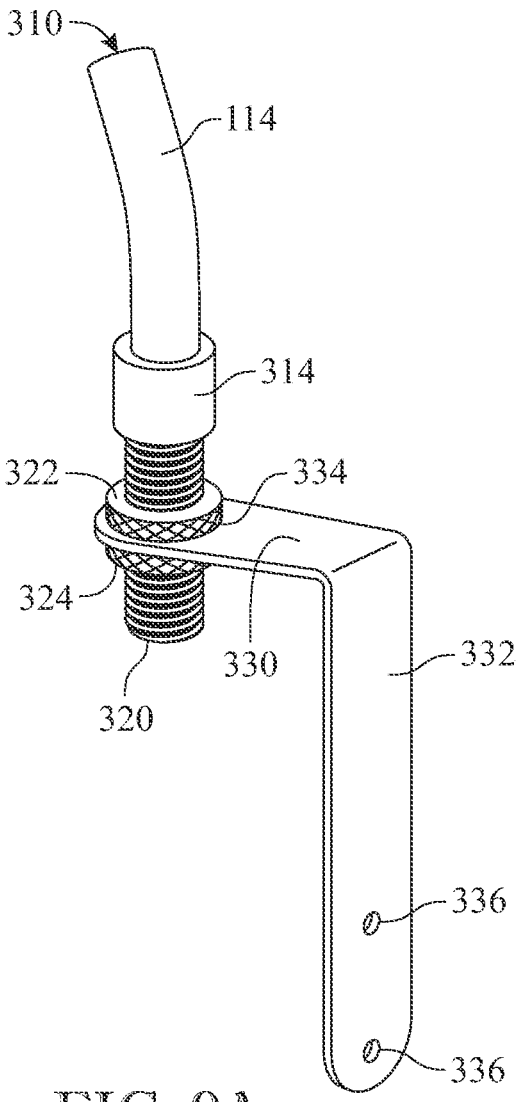
FIG. 9A presents a front isometric view of a bullet drop tube and mounting bracket assembly of the of the improved bullet feeder and seating die device of FIG. 1.
Figure 9B:
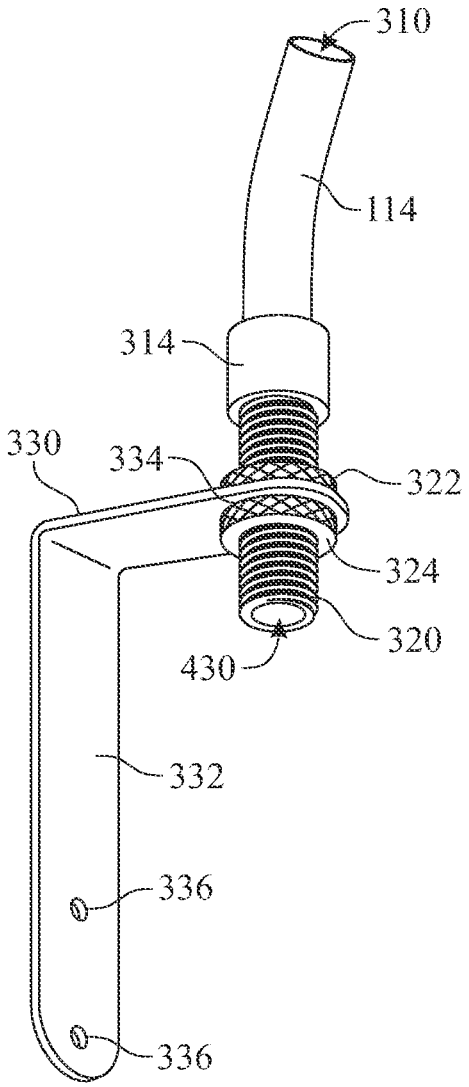
FIG. 9B presents a rear isometric view of the bullet drop tube and mounting bracket assembly of FIG. 9A.

Turning now to FIGS. 9A and 9B, and in particular FIG. 9B, the threaded extension 320 has a hollow bore 430. The bore 430 of the threaded extension 320 is in communication with the bore 310 of the drop tube 114 for the passage of bullets therethrough.

Turning now to FIGS. 1-3, in use, the bullet seating die 110 is positioned against the main body holder 124 of the mounting assembly 122 and secured thereto by engaging the outside body holder 126 to the main body holder 124 and securing it in place with the set screw 230. The die lock 130 is threaded onto the seating die 110 such that the clearance cut 160 of the main die body 140 and the clearance slot 190 of the die lock 130 are in alignment. The die lock 130 is then installed on a bullet seating press in bayonet fashion.

Bullets (not shown) are inserted into the drop tube 114 to load the bullet feeder device 100. An initial bullet drops into the feed hole 290 of the second indexing block 118. Because the first and second indexing blocks 116 and 118 are initially biased out of alignment, the bullet does not drop through the feed hole 290.

The bullet feeder device 110 is activated by raising a cartridge casing (not shown) upward until it engages and enters the chamfered inner surface 420 (FIG. 7B) of activation sleeve 120. The rising cartridge casing drives the activation sleeve 120 upwards within the main die body 140 until the top circumferential edge 264 of the activation sleeve 120 engages the front edge 262 of the actuator 250. The actuator 250 is driven up to drive the drive shaft 270 through the first indexing block 116 and into engagement with the second indexing block 218.

As the drive shaft 270 engages the second indexing block 118, it causes the second indexing block to pivot into alignment with the first indexing block 116 such that the feed hole 390 of the second indexing block 118 is in alignment with the drop hole 280 of the first indexing block 116. At this point, the bullet is free to fall through the feed hole 290 and the drop hole 280 and onto the feed ramp 260 of the actuator 250. The bullet passes through the passageway 350 in the main die body 140 and moves aside the pusher 170 which is free to pivot out of the way. As the bullet pushes the pusher 170 out of the way, the bullet falls into the activation sleeve 120 and is temporarily restrained by the o-ring 414 projecting into the bore 410 of the activation sleeve 120.

Continued operation of the die press raises the activation sleeve 120, now supporting the bullet with the o-ring 414, further up into the main die body 140 of the seating die 110 until the pusher 170 engages the bullet and urges the bullet into a open mouth of the cartridge casing to seat the bullet in the cartridge casing. The seating die 110 may include crimping features to secure the bullet in the cartridge casing. As the bullet and cartridge casing are lowered, the drive shaft 270 of the actuator 250 is biased out of engagement with the second indexing block 118 by the biasing spring 252. Once the second indexing block 118 returns to the initial position under the threaded extension 320, another bullet is deposited in the feed hole 290 of the second indexing block 118 and the process can be repeated.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A bullet feeder and seating device for seating a bullet in a mouth of a cartridge casing, the bullet feeder device comprising:

a seating die including a main die body having a smooth outer surface and a threaded outer surface and defining an inner bore, said main die body defining a clearance cut extending through said smooth outer surface and said threaded outer surface to said inner bore, said main die body defining a passageway extending through said smooth outer surface and said threaded outer surface to said inner bore, and an inner die assembly having a pivotal bullet pusher;

a die lock having a threaded inner surface engageable with said threaded outer surface of said main die body, said die lock defining a clearance slot alignable with said clearance cut in said main die body;

an activation sleeve movably mounted within said main die body and defining an inner bore;

a mounting assembly including a main body holder defining a channel, said seating die being removably attached to said main body holder;

an actuator having a rectangular portion and a triangular portion extending from said rectangular portion and a drive shaft extending upward from said rectangular portion, said rectangular portion being slidably mounted within said channel of said main body holder;

a first indexing block mounted on said main body holder and defining a drop hole and a shaft hole;

a second indexing block pivotally mounted on said first indexing block and defining a feed hole and a cam surface on an underside of said second indexing block; and a feed tube mounted above said second indexing block.

2. The bullet feeder and seating device of claim 1 wherein the passageway in the main die body is positioned diametrically opposite the clearance cut in the main die body.

3. The bullet feeder and seating device of claim 1, wherein a biasing spring is positioned over the drive shaft and under the first indexing block.

4. The bullet feeder and seating device of claim 1, wherein the activation sleeve is movably mounted within the seating die and is operable to pivot the second indexing block so as to release a bullet into the seating die.

5. The bullet feeder and seating device of claim 1, wherein the mounting assembly also includes an outside body holder for securing the seating die to the main body holder and a mounting bracket affixed to the feed tube and the main body holder to support and position the feed tube over the first and second indexing blocks.

6. The bullet feeder and seating device of claim 5, wherein the main body holder includes a channel shaped body portion defining an interior channel and wherein the body portion of the main body holder further includes vertical side grooves for securing the mounting bracket, and the feed tube, to the main body holder.

7. The bullet feeder and seating device of claim 5, wherein the main die body also includes a smaller diameter lower end.

8. The bullet feeder and seating device of claim 1, wherein the inner die assembly additionally includes an adjustment shaft connected to the pusher and mounted within a pusher support.

9. The bullet feeder and seating device of claim 8, wherein the pusher support has a hollow lower sleeve and a threaded upper portion which is threadingly engageable with the inner threaded surface of the main die body to secure the inner die assembly within the main die body.

10. The bullet feeder and seating device of claim 9 wherein the pusher support has a collar to facilitate rotating the inner die assembly into the main die body.

11. The bullet feeder and seating device of claim 8, wherein the adjustment shaft includes a threaded outer surface which engages a threaded inner surface of the pusher support.

12. The bullet feeder and seating device of claim 1, further comprising a plurality of projections extending from a body of the die lock.

13. The bullet feeder and seating device of claim 1, wherein the inner die assembly is mounted within the main die body and where the main die body has a threaded inner surface in an upper end of the main die body for adjustably receiving the inner die assembly.

14. The bullet feeder and seating device of claim 1, wherein the die lock includes a threaded inner surface threadingly engageable with the threaded outer surface of the main die body.

15. The bullet feeder and seating device of claim 1, wherein the die lock defines an internal bore for receipt of the seating die and passage of the pusher.

16. The bullet feeder and seating device of claim 7, wherein the activation sleeve forms part of an activation assembly and includes an enlarged upper end having a lower edge which is larger in diameter that the smaller diameter lower end of the main die body, such that the activation sleeve is retained within the bore of the main die body.

17. The bullet feeder and seating device of claim 16 wherein the activation assembly includes the actuator, slidably mounted in the main body holder and a biasing spring for biasing the actuator and the activation sleeve downward within the bullet feeding device.

18. The bullet feeder and seating device of claim 1, wherein the first indexing block further includes a mounting hole for securing the first indexing block to a top edge of a channel shaped body portion of the main body holder.

19. The bullet feeder and seating device of claim 1, wherein the second indexing block also includes a mounting hole, and a mounting bolt or screw which is provided to mount both the first and second indexing blocks to the man body holder.

20. The bullet feeder and seating device of claim 1, further comprising a bullet.

* * * * *